US005258254A

United States Patent [19]

Moriya

[11] Patent Number: 5,258,254

[45] Date of Patent: Nov. 2, 1993

[54] TONER FOR DEVELOPING STATIC CHARGE IMAGES

[75] Inventor: Yuichi Moriya, Shizuoka, Japan

[73] Assignee: Tomoegawa Paper Co., Ltd., Tokyo, Japan

[21] Appl. No.: 856,717

[22] Filed: Mar. 24, 1992

[30] Foreign Application Priority Data

Mar. 26, 1991 [JP] Japan ..... 3-084587
Mar. 26, 1991 [JP] Japan ..... 3-084588
Mar. 26, 1991 [JP] Japan ..... 3-084589

[51] Int. Cl.[5] ..... G03G 9/083
[52] U.S. Cl. ..... 430/106.6; 430/109
[58] Field of Search ..... 430/106, 106.6, 122, 430/109

[56] References Cited

U.S. PATENT DOCUMENTS 5,139,914 8/1992 Tomiyama et al. ..... 430/106.6
5,158,852 10/1992 Sakata et al. ..... 430/106.6

*Primary Examiner*—John Goodrow
*Attorney, Agent, or Firm*—Thompson, Hine and Flory

[57] ABSTRACT

A toner is disclosed for developing a static image, comprising an electrically conductive magnetic toner and an electrically insulating non-magnetic toner. The electrically conductive magnetic toner contains magnetic powder and has a coloring agent attached thereto, and a volumetric resistivity of $1\times10^3\Omega\cdot$cm or lower, and the electrically insulating non-magnetic has a coloring agent attached thereto, and a volumetric resistivity of $1\times10^9\Omega\cdot$cm or higher.

6 Claims, No Drawings

TONER FOR DEVELOPING STATIC CHARGE IMAGES

BACKGROUND OF THE INVENTION

1. Field of the Invention

The present invention relates to a toner for developing static charge images, and more particularly to a toner for use in a system with low developing potential.

2. Description of Related Arts

Electrophotography generally refers to the formation of an electrical latent image on a photo-sensitive medium, which is developed by a toner and transferred, as necessary, to paper or other suitable media, and fixed under heat or pressure. The developing agents used for electrophotography fall into two general categories: two-component agents consisting of a toner and a carrier, and one-component agents provided with both toner and carrier functions.

The one-component agents are further subdivided into magnetic and non-magnetic types, the former containing 10% to 70% by weight of magnetic powder. The magnetic type is still further subdivided, in terms of developing driving force, into electrically conductive and insulating types, the former being driven by electrostatic induction or charge injection, and the latter by triboelectrification.

Development by one-component electrically-conductive (hereafter, "conductive" refers to electrical conductivity) magnetic toner yields uniform images having no edge effects, because the conductive magnetic toner itself works as the developing electrode. It is also known that such a toner type has the advantage of being applicable to a low-potential development system having a developing potential of 100 V or less, by controlling the volumetric resistivity of the toner at roughly below $1\times10^4\Omega\cdot$cm.

However, the conductive magnetic toner has several disadvantages. The charges tend to leak via the transfer paper during the electrostatic transfer process, making it difficult to transfer the toner onto plain paper. Another disadvantage is the difficulty in securing the necessary image concentrations, as the toner particles are developed in only one layer on the photosensitive medium.

The above transfer-related problems are solved to some extent by using paper specially treated to have high resistivity or by employing a pressure transfer process in which a rubber roller is used. However, it is essential to secure image concentrations in the transfer process, which is not satisfactorily realized by the prior art.

SUMMARY OF THE INVENTION

It is an object of the present invention to provide toner for developing static charge images which can secure sufficient image concentrations and further to produce a fog-free image with good characteristics by means of a low-potential developing system, thereby solving the problems described above.

The present invention provides a toner for developing a static image comprising an electrically conductive magnetic toner and an electrically insulating non-magnetic toner, in which the electrically conductive magnetic toner contains magnetic powder and has a volumetric resistivity of $1\times10^3\Omega\cdot$cm or lower, and the electrically insulating non-magnetic toner has a coloring agent attached to the surface thereof and has a volumetric resistivity of $1\times10^9\Omega\cdot$cm or higher.

The present invention further comprises a toner for developing a static image, characterized by comprising electrically conductive magnetic toner and electrically insulating non-magnetic toner, in which the electrically conductive magnetic toner contains 30% to 70% by weight of magnetic powder and has a volumetric resistivity of $1\times10^3\Omega\cdot$cm or lower; and the electrically insulating non-magnetic toner having a volumetric resistivity of $1\times10^9\Omega\cdot$cm or higher, in which 0.2 to 2.0 parts by weight of a coloring agent are attached at the surface thereof to 100 parts by weight of the particles of the electrically insulating non-magnetic toner.

The present invention further provides a toner for developing a static image comprising an electrically conductive magnetic toner and an electrically insulating non-magnetic toner, in which the electrically conductive magnetic toner contains 30% to 70% by weight of magnetic powder and has a volumetric resistivity of $1\times10^3\Omega\cdot$cm or lower; and the electrically insulating non-magnetic toner has a volumetric resistivity of $1\times10^9\Omega\cdot$cm or higher, in which 0.2 to 2.0 parts by weight of carbon black are attached at the surface thereof beforehand to 100 parts by weight of the particles of the electrically insulating non-magnetic toner; and in which the electrically conductive magnetic toner and the electrically insulating non-magnetic toner are blended in a ratio ranging between 60:40 and 90:10 by weight.

The present invention further comprises a toner for developing a static image, comprising an electrically conductive magnetic toner and an electrically insulating non-magnetic toner, in which the electrically conductive magnetic toner contains 30% to 70% by weight of magnetic powder and has a volumetric resistivity of $1\times10^3\Omega\cdot$cm or lower, and the electrically insulating non-magnetic toner has a volumetric resistivity of $1\times10^9\Omega\cdot$cm or higher; in which the electrically conductive magnetic toner and the electrically insulating non-magnetic toner are blended in a ratio ranging between 60:40 and 90:10 by weight, and the electrically insulating non-magnetic toner has a volumetric average particle size 1.1 to 1.5 times larger than that of the electrically conductive magnetic toner.

The present invention further provides a toner for developing a static image, comprising an electrically conductive magnetic toner and an electrically insulating non-magnetic toner, in which the electrically conductive magnetic toner contains 30% to 70% by weight of magnetic powder and has a volumetric resistivity of $1\times10^3\Omega\cdot$cm or lower; and the electrically insulating non-magnetic toner has a volumetric resistivity of $1\times10^9\Omega\cdot$cm or higher and a sphericalness of 0.5 or higher; in which the electrically conductive magnetic toner and the electrically insulating non-magnetic toner are mixed together in a ratio ranging from 60:40 to 90:10 by weight.

The present invention further provides a toner for developing a static image, comprising an electrically conductive magnetic toner and an electrically insulating non-magnetic toner, in which the electrically conductive magnetic toner contains 30% to 70% by weight of magnetic powder and has a volumetric resistivity of $1\times10^3\Omega\cdot$cm or lower; and the electrically insulating non-magnetic toner has a volumetric resistivity of $1\times10^9\Omega\cdot$cm or higher, in which 0.2 to 2.0 parts by weight of carbon black are attached at the surface thereof beforehand to 100 parts by weight of the particles of the electrically insulating non-magnetic toner; and in which the electrically conductive magnetic toner and the electrically insulating non-magnetic toner are blended in a ratio ranging between 60:40 and 90:10 by weight; and in which the electrically insulating non-magnetic toner furthermore comprises at least one of styrene acrylic resin, polypropylene, carbon black, and monoazo metal complex dye.

DETAILED DESCRIPTION OF THE PREFERRED EMBODIMENTS

The volumetric resistivity of the conductive magnetic toner of the present invention was determined in an electrical field of 100 V/cm, in which a sample was placed in a cylindrical electrode having a major electrode area of 1.00 $cm^2$ and to which a load of 200 $g/cm^2$ was applied.

The volumetric resistivity of an insulating non-magnetic toner is substantially different from that of a conductive magnetic toner and cannot be determined by the same analytical method. The volumetric resistivity of the insulating non-magnetic toner is determined by a 2500 A capacitance bridge (supplied by ANDEEN-HAGERLING, INC) for a sample formed under a pressure of 200 $kg/cm^2$ and attached to the solid electrodes (SE-70, supplied by Andoh Electric Company, Ltd.).

The conductive toner is prepared from magnetic powder and carbon black, which are dispersed in a binder resin, mechanically crushed, and classified to produce powder having a volumetric average particle size of 7 to 10 $\mu$m. A sufficient amount of an additive to improve fluidity of the powder may be attached to the classified powder surfaces, such as carbon black or another electrically conductive agent (in order to make the conductivity uniform over the surfaces) or silica.

The binder resins useful for the conductive magnetic toner of the present invention include: thermoplastic resins such as polystyrene, polyethylene, polypropylene, vinyl-base resin, polyacrylate, polymethacrylate, polyvinylidene chloride, polyacrylonitrile, polyether, polycarbonate, thermoplastic polyester, thermoplastic epoxy resin, and cellulose-base resin; copolymers of the monomers for the above resins; and thermosetting resins, such as modified acrylic resin, phenolic resin, melamine resin and urea resin.

The magnetic powders useful for the present invention include ferrite and magnetite having the spinel, perovskite, hexagonal, garnet and orthoferrite crystalline structures. The ferrite is a sintered body of an oxide of nickel, zinc, manganese, magnesium, copper, lithium, barium, vanadium, chromium or calcium sintered with trivalent iron.

The electrically insulating non-magnetic toner (hereafter, "insulating" means electrically insulating) may also be produced by crushing and classification of the adhesive resin dispersed with a coloring agent such as carbon black or an adequate agent to control the extent of electrification. The above agent may be added during the resin polymerization process to directly produce the insulating non-magnetic toner powder having the desired particle size.

The aforementioned resins useful for the conductive magnetic toner may also be used as necessary for the insulating non-magnetic toner. Moreover, monoazo-base metallic dyestuff, nigrosine-base dyestuff or quaternary ammonium salt may be used as necessary as the agent to control the extent of electrification.

The toner for developing the static charge image of the present invention, according to a first embodiment, is a toner comprising an electrically conductive magnetic toner and an electrically insulating non-magnetic toner in which the electrically conductive magnetic toner contains magnetic powder and has a volumetric resistivity of $1\times10^3\Omega\cdot$cm or lower, and the electrically insulating non-magnetic toner has a coloring agent attached at its surface and has a volumetric resistivity of $1\times10^9\Omega\cdot$cm or higher; and this toner was developed to solve the aforementioned problems. It is characterized by comprising electrically conductive magnetic toner and electrically insulating non-magnetic toner mixed in a ratio ranging from 60:40 to 90:10 by weight, where the former contains 30% to 70% by weight of magnetic powder and has a volumetric resistivity of $1\times10^3\Omega\cdot$cm or lower, and the latter contains 0.2 to 2.0 parts by weight of carbon black per 100 parts by weight of the toner particles and has a volumetric resistivity of $1\times10^9\Omega\cdot$cm or higher.

The toner for developing the static charge image of the present invention, as in the first embodiment, may be used to prepare insulating non-magnetic toner by attaching 0.2 to 2.0 parts by weight of carbon black to the surfaces of 100 parts by weight of the toner particles prepared above. Moreover, an adequate agent such as silica may be attached to the surfaces to improve fluidity.

Any type of carbon black may be attached to the surfaces of the insulating non-magnetic toner particles, irrespective of the average particle size, oil absorbency, and pH level. Some such commercially available products include Cabot's (USA) REGAL 400R, 660R and 330R; Columbia Carbon Japan's RAVEN 410, 420, 430 and 450; and Mitsubishi Kasei's #40, #2400B and MA-100. These carbon black products may be used alone or in combination.

A common mixer, such as a turbine-type agitator, super-mixer, or Henschel may be used as the means to attach carbon black to the surfaces of the electrically insulating non-magnetic toner.

The toner for developing the static charge image according to the second embodiment of the present invention, is characterized by comprising conductive magnetic toner and electrically insulating non-magnetic toner mixed in a ratio ranging from 60:40 to 90:10 by weight, where the former contains 30% to 70% by weight of magnetic powder and has a volumetric resistivity of $1\times10^3\Omega\cdot$cm or lower, and the latter has a volumetric resistivity of $1\times10^9\Omega\cdot$cm or higher, and a volumetric average particle size which is 1.1 to 1.5 times larger than that of the conductive magnetic toner.

Moreover, an adequate agent such as silica may be attached to the surfaces of the above toner for developing the static image to improve its fluidity.

The toner for developing the static charge image according to the third embodiment of the present invention is characterized by comprising electrically conductive magnetic toner and electrically insulating non-magnetic toner mixed in a ratio ranging of from 60:40 to 90:10 by weight, where the former contains 30% to 70% by weight of magnetic powder and has a volumetric resistivity of $1\times10^3\Omega\cdot$cm or lower, and the latter has a volumetric resistivity of $1\times10^9\Omega\cdot$cm or higher and sphericalness of 0.5 or higher.

The sphericalness of the insulating non-magnetic toner particles may be determined by the following method:

Take a photograph of the toner images using a scanning electron microscope (SEM), and input the images in an image-processing apparatus.

Then determine their degree of sphericalness using the following formula:

$$\text{Sphericalness} = (4\pi \times \text{area})/(\text{peripheral length})^2$$

The sphericalness value will be 1 when the object in question is completely spherical, and approaches 0 when the object has an indefinite shape.

The insulating non-magnetic toner may be produced by crushing and classification of the adhesive resin dispersed with a coloring agent such as carbon black or an agent to control the extent of electrification. The toner particles are further treated by a method (such as thermal treatment in a high-temperature airflow, or a mechanical method to impact them in a high-speed airflow) to make the particles more spherical, and to increase their sphericalness to 0.5 or higher. Spray drying of the toner material dispersed in a solvent is another method for producing the desired insulating non-magnetic toner. Carbon black or an agent to control the extent of electrification may be added to the binder resin during the resin polymerization process in order to directly produce the insulating non-magnetic toner powder having the desired particle size. Suspension and emulsion polymerization are the preferred polymerization processes. Moreover, an agent such as silica may be attached to the surfaces of the above toner to improve its fluidity.

The aforementioned resins useful for the conductive magnetic toner may also be used, as necessary, for the insulating non-magnetic toner. Moreover, monoazo-base metallic dyestuff, nigrosine-base dyestuff, or quaternary ammonium salt may be used as necessary as the agent to control the extent of electrification.

The conductive magnetic toner for the toner for developing the static charge image of the present invention is developed by a method whereby charges are injected by static induction or by means of a developing sleeve under a developing electrical field. The conductive magnetic toner will be attracted to the latent image on the photosensitive medium when static electrical attraction between the latent image and the conductive magnetic toner surpasses the magnetic constraining force to develop the image. The insulating non-magnetic toner, on the other hand, will be charged by the friction between the spike-height limiting blade at the developer and the conductive magnetic toner to be developed on the latent image. Therefore, a number of the conductive magnetic toner and insulating non-magnetic toner particles is attracted to the latent image on the photosensitive medium, where they are mixed with each other to enhance image density.

The particles of the toner for developing the static charge image of the present invention are mixed and stirred in the developer, and the spikes of the electrically conductive magnetic toner are formed on the developing sleeve by means of a magnetic roller. It is therefore necessary for the conductive magnetic toner to contain 30% to 70% by weight of the magnetic powder. The toner for developing the static charge image will have insufficient magnetic force if the concentration of the magnetic powder is less than 30%, resulting in poor transport-related properties of the toner. The presence of magnetic powder in excess of 70%, on the other hand, makes it difficult to disperse the magnetic powder in the binder resin and, at the same time, to secure the necessary conductivity due to the excessively low concentration of the conductive material, such as carbon black. The insulating non-magnetic toner particles are attracted to the conductive magnetic toner by the electrostatic force resulting from friction-induced electrification, to be transported to the latent image, as is the case with the conductive magnetic toner. The conductive magnetic toner and the electrically insulating non-magnetic toner are mixed in a ratio preferably in a range between 60:40 and 90:10. The presence of the insulating non-magnetic toner in a ratio in excess of 40 (the conductive magnetic toner is present in a ratio below 60) will degrade the transport-related ability of the toner to develop a static charge image, as it is provided with the conductive magnetic toner, and will cause other problems such as flaking or scattering of the toner. On the other hand, the presence of the electrically insulating non-magnetic toner in a ratio below 10 (the conductive magnetic toner is present in a ratio in excess of 90) will make it difficult to secure sufficient image concentration.

Volumetric resistivity of the electrically conductive magnetic toner in excess of $1\times10^3\Omega\cdot$cm increases that of the toner for developing a static charge image, making it difficult to develop the image at a low potential. A volumetric resistivity of the insulating non-magnetic toner below $1\times10^9\Omega\cdot$cm, on the other hand, will make it difficult to retain a sufficient quantity of friction-induced charges and hence to secure sufficient image concentration due to excessive leaking of the charges.

The toner for developing a static charge image of the present invention, according to the first embodiment, prevents part of the exposed carbon black on the conductive magnetic toner particle surfaces from moving toward the insulating non-magnetic toner particle surfaces, thus retarding the injection of charges into the conductive magnetic toner and resulting in fog or other problems with the images produced. Therefore, carbon black is attached to the insulating non-magnetic toner particle surfaces before they are mixed with the conductive magnetic toner particle surfaces in order to prevent movement of carbon black. The quantity of carbon black to be attached beforehand to the insulating non-magnetic toner particle surfaces is preferably in a range of from 0.2 to 2.0 per 100 parts by weight of the toner particles, preferably between 0.5 and 1.5 parts by weight. A ratio below 0.2 parts by weight is too low to adequately prevent the movement of carbon black, resulting in degraded images. A ratio above 2.0 parts by weight, on the other hand, may reduce the quantity of friction-induced charges on the electrically insulating non-magnetic toner, resulting in lowered image concentration.

The toner for developing a static charge image of the present invention, according to the second embodiment, is mixed in a developing apparatus, preventing part of the exposed carbon black on the conductive magnetic toner particle surfaces from moving toward the insulating non-magnetic toner particle surfaces; it is therefore necessary for the insulating non-magnetic toner particles to have a volumetric average size that is 1.1 to 1.5 times larger than that of the conductive magnetic toner particles. This is to minimize the quantity of carbon black moving toward the insulating non-magnetic toner by controlling the volumetric average particle size of the electrically insulating non-magnetic toner to be larger than that of the electrically conductive magnetic toner, and thereby to make the surface area per unit weight of the former toner smaller than that of the latter toner. A ratio below 1.1 is too low to adequately prevent the movement of carbon black toward the insulating non-magnetic toner particles due to the relatively large surface area of these particles, thus resulting in degraded images. A ratio above 1.5, on the other hand, increases particle size as a whole, also resulting in degraded images.

The toner for developing a static charge image of the present invention, according to the third embodiment, is mixed in a developing apparatus, preventing part of the exposed carbon black on the conductive magnetic toner particle surfaces from moving toward the insulating non-magnetic toner particle surfaces, in order to produce a sphericalness of 0.5 or higher. Therefore, the insulating non-magnetic toner particles are controlled to have a sphericalness of 0.5 or higher for the toner of the present invention in order to prevent degradation of the images produced by minimizing the surface area of these particles and thereby controlling the quantity of carbon black moving from the electrically conductive magnetic toner particles.

PREFERRED EMBODIMENTS

The present invention is further illustrated by the following examples. The term "parts" hereinbelow means parts by weight.

EXAMPLE 1

| | |
|---|---|
| Epoxy resin (Epicoat 1004, supplied by Yuka Shell Epoxy KK) | 40 parts |
| Magnetite (KBC-100, supplied by Kanto Denka Kogyo Co., Ltd.) | 50 parts |
| Carbon black (Ketjen EC, supplied by Lion Akzo Co., Ltd.) | 10 parts |

The above composition was melted and kneaded in a kneader equipped with two rollers, crushed by a jet mill, and classified to produce electrically conductive magnetic toner particles having a volumetric average size of 9 μm. Its volumetric resistivity was $5\times10^2\Omega\cdot$cm.

| | |
|---|---|
| Styrene acrylic resin (Mw: 120,000, Mn: 6,000, Mw/Mn: 20) | 90 parts |
| Polypropylene (Viscol 660P: supplied by Sanyo Chemical Industries, Ltd.) | 3 parts |
| Carbon black (#40, supplied by Mitsubishi Kasei Corporation) | 5 parts |
| Monoazo metal complex dye (Bontron S-44, supplied by Orient Chemical Industrial Co., Ltd.) | 2 parts |

The above composition was melted and kneaded in a kneader equipped with two rollers, crushed by a jet mill, and classified to produce toner particles having a volumetric average size of 9 μm. One part by weight of carbon black (#40, supplied by Mitsubishi Kasei Corporation) was mixed with 100 parts of the above particles to prepare the electrically insulating non-magnetic toner. The volumetric resistivity of the electrically insulating non-magnetic toner was $3\times10^{10}\Omega\cdot$cm.

The electrically conductive magnetic toner and the electrically insulating non-magnetic toner, both as prepared above, were mixed at a ratio of 70/30 by weight to produce the toner for developing the static charge image of the present invention.

(EXAMPLE 2)

| | |
|---|---|
| Styrene acrylic resin (Mw: 60,000, Mn: 6,000, Mw/Mn: 10) | 40 parts |
| Magnetite (KBC-100, supplied by Kanto Denka Kogyo Co., Ltd.) | 50 parts |
| Carbon black (Ketjen EC, supplied by Lion Akzo Co., Ltd.) | 10 parts |

The above composition was melted and kneaded in a kneader equipped with two rollers, crushed by a jet mill, and classified to produce the electrically conductive magnetic toner particles having a volumetric average size of 9 μm. Its volumetric resistivity was $8\times10^2\Omega\cdot$cm.

| | |
|---|---|
| Styrene acrylic resin (Mw: 120,000, Mn: 6,000, Mw/Mn: 20) | 89 parts |
| Polypropylene (Viscol 660P: supplied by Sanyo Chemical Industries, Ltd.) | 2 parts |
| Carbon black (#40, supplied by Mitsubishi Kasei Corporation) | 7 parts |
| Monoazo metal complex dye (Bontron S-44, supplied by Orient Kaaku Kogyo) | 2 parts |

The above composition was melted and kneaded in a kneader equipped with two rollers, crushed by a jet mill, and classified to produce toner particles having a volumetric average size of 9 μm. 0.5 parts by weight of carbon black (#40, supplied by Mitsubishi Kasei Corporation) was mixed with 100 parts of the above particles to prepare the electrically insulating non-magnetic toner. The volumetric resistivity of the electrically insulating non-magnetic toner was $9\times10^9\Omega\cdot$cm.

The electrically conductive magnetic toner and the electrically insulating, non-magnetic toner, both prepared as above, were mixed at a ratio of 70/30 by weight to produce the toner for developing the static charge image of the present invention.

(COMPARATIVE EXAMPLE 1)

| | |
|---|---|
| Epoxy resin (Epicoat 1004, supplied by Yuka Shell Epoxy KK) | 43 parts |
| Magnetite (EPT-500, supplied by Toda Kogyo Corp.) | 50 parts |
| Carbon black (Ketjen EC, supplied by Lion Akzo Co., Ltd.) | 7 parts |

The above composition was melted and kneaded in a kneader equipped with two rollers, crushed by a jet mill, and classified to produce electrically conductive, magnetic toner particles having a volumetric average size of 9 μm. Its volumetric resistivity was $6\times10^4\Omega\cdot$cm.

The electrically conductive magnetic toner and the electrically insulating non-magnetic toner prepared in EXAMPLE 1 were mixed at a ratio of 70/30 by weight to produce the toner for developing the static charge image of COMPARATIVE EXAMPLE 1.

(COMPARATIVE EXAMPLE 2)

| | |
|---|---|
| Styrene acrylic resin | 83 parts |

-continued

| | |
|---|---|
| (Mw: 120,000, Mn: 6,000, Mw/Mn: 20) | |
| Polypropylene (Viscol 660P: supplied by Sanyo Chemical Industries, Ltd.) | 3 parts |
| Carbon black (#40, supplied by Mitsubishi Kasei Corporation) | 12 parts |
| Monoazo metal complex dye (Bontron S-44, supplied by Orient Chemical Industrial Co., Ltd.) | 2 parts |

The above composition was melted and kneaded in a kneader equipped with two rollers, crushed by a jet mill, and classified to produce toner particles having a volumetric average size of 9 μm. One part of weight of carbon black (#40, supplied by Mitsubishi Kasei Corporation) was mixed with 100 parts of the above particles to prepare the electrically insulating non-magnetic toner. The volumetric resistivity of the electrically insulating non-magnetic toner was $6\times10^{8}\Omega\cdot$cm.

The electrically conductive magnetic toner prepared in EXAMPLE 1 and the above electrically insulating non-magnetic toner were mixed at a ratio of 70/30 by weight to produce the toner for developing the static charge image of COMPARATIVE EXAMPLE 2.

(COMPARATIVE EXAMPLE 3)

The same procedure as used for EXAMPLE 1 was repeated (except that no carbon black was added) to produce the electrically insulating non-magnetic toner. Its volumetric resistivity was $5\times10^{10}\Omega\cdot$cm.

The electrically conductive magnetic toner prepared in EXAMPLE 1 and the above electrically insulating non-magnetic toner were mixed at a ratio of 70/30 by weight to produce the toner for developing the static charge image of COMPARATIVE EXAMPLE 3.

(COMPARATIVE EXAMPLE 4)

The same procedure as used for EXAMPLE 1 was repeated (except that 3 parts by weight carbon black were added) to produce the electrically insulating non-magnetic toner. Its volumetric resistivity was $2\times10^{10}\Omega\cdot$cm.

The electrically conductive magnetic toner prepared in EXAMPLE 1 and the above electrically insulating non-magnetic toner were mixed at a ratio of 70/30 by weight to produce the toner for developing the static charge image of COMPARATIVE EXAMPLE 4.

(COMPARATIVE EXAMPLE 5)

Only the electrically conductive magnetic toner prepared in EXAMPLE 1 was used to produce the toner for developing the static charge image of COMPARATIVE EXAMPLE 5.

(COMPARATIVE EXAMPLE 6)

The electrically conductive magnetic toner and the electrically insulating non-magnetic toner, both prepared in EXAMPLE 1, were mixed at a ratio of 50/50 by weight to produce the toner for developing the static charge image of COMPARATIVE EXAMPLE 6.

The toners for developing the static charge image, prepared in EXAMPLES 1 and 2 and COMPARATIVE EXAMPLES 1 through 6, were tested by an LED reversal printer operating at a developing potential of 40 V. The results are given in Table 1.

TABLE 1

| Samples | Image Concentration | Fog Level | Resolution | Remarks |
|---|---|---|---|---|
| EXAMPLE 1 | 1.39 | 0.005 | Good | Nothing in particular |
| EXAMPLE 2 | 1.38 | 0.006 | Good | Nothing in particular |
| COMPARATIVE EXAMPLE 1 | 1.07 | 0.009 | Slightly bad | Nothing in particular |
| COMPARATIVE EXAMPLE 2 | 1.29 | 0.013 | Slightly bad | The toner was scattered to some extent |
| COMPARATIVE EXAMPLE 3 | 1.40 | 0.022 | Good | Nothing in particular |
| COMPARATIVE EXAMPLE 4 | 1.16 | 0.009 | Slightly bad | Nothing in particular |
| COMPARATIVE EXAMPLE 5 | 0.52 | 0.005 | Good | Nothing in particular |
| COMPARATIVE EXAMPLE 6 | 1.40 | 0.025 | Bad | The toner was scattered |

Image concentration and fog level in Table 1 were determined by a reflection density meter (Macbeth RD914) and a Reflectometer (TC-6D, supplied by Tokyo Denshoku Co., Ltd.), respectively.

As illustrated in Table 1, the toners for developing the static charge image of the present invention produced satisfactory image concentration and high-quality images having little fog. By contrast, it was confirmed that concentrations of images formed by the toners of COMPARATIVE EXAMPLES 1, 4, and 5 were low, and the images formed by the toners of COMPARATIVE EXAMPLES 2, 3, and 6 were fogged to such an extent as to be impractical.

(EXAMPLE 3)

| | |
|---|---|
| Epoxy resin (Epicoat 1004, supplied by Yuka Shell Epoxy KK) | 40 parts |
| Magnetite (KBC-100, supplied by Kanto Denka Kogyo Co., Ltd.) | 50 parts |
| Carbon black (Ketjen EC, supplied by Lion Akzo Co., Ltd.) | 10 parts |

The above composition was melted and kneaded in a kneader equipped with two rollers, crushed by a jet mill, and classified to produce the electrically conductive magnetic toner particles having a volumetric average size of 9 μm. Its volumetric resistivity was $5\times10^{2}\Omega\cdot$cm.

| | |
|---|---|
| Styrene acrylic resin (Mw: 120,000, Mn: 6,000, Mw/Mn: 20) | 90 parts |
| Polypropylene (Viscol 660P: supplied by Sanyo Chemical Industries, Ltd.) | 3 parts |
| Carbon black (#40, supplied by Mitsubishi Kasei Corporation) | 5 parts |
| Monoazo metal complex dye (Bontron S-44, supplied by Orient Chemical Industrial Co., Ltd.) | 2 parts |

The above composition was melted and kneaded in a kneader equipped with two rollers, crushed by a jet mill, and classified to produce toner particles having a volumetric average size of 11 μm. 0.2 parts by weight of hydrophobic silica (R-972, supplied by Nippon Aerosil Co., Ltd.) were mixed with 100 parts of the above particles to prepare the electrically insulating non-magnetic toner. The volumetric resistivity of the electrically insulating non-magnetic toner was $3\times10^{10}\Omega\cdot$cm.

The electrically conductive magnetic toner and the electrically insulating non-magnetic toner, both prepared as above, were mixed at a ratio of 75/25 by weight to produce the toner for developing the static charge image of the present invention.

(EXAMPLE 4)

| | |
|---|---|
| Styrene acrylic resin (Mw: 60,000, Mn: 6,000, Mw/Mn: 10) | 40 parts |
| Magnetite (KC-100, supplied by Kanto Denka Kogyo Co., Ltd.) | 50 parts |
| Carbon black (Ketjen EC, supplied by Lion Akzo Co., Ltd.) | 10 parts |

The above composition was melted and kneaded in a kneader equipped with two rollers, crushed by a jet mill, and classified to produce toner particles having a volumetric average size of 11 μm. 0.2 parts by weight of hydrophobic silica (R-972, supplied by Nippon Aerosil) were mixed with 100 parts of the above particles to prepare the electrically insulating non-magnetic toner. The volumetric resistivity of the electrically insulating non-magnetic toner was $9\times10^{9}\Omega\cdot$cm.

| | |
|---|---|
| Styrene acrylic resin (Mw: 120,000, Mn: 6,000, Mw/Mn: 20) | 89 parts |
| Polypropylene (Viscol 660P: supplied by Sanyo Chemical Industries, Ltd.) | 2 parts |
| Carbon black (#40, supplied by Mitsubishi Kasei Corporation) | 7 parts |
| Monoazo metal complex dye (Bontron S-44, supplied by Orient Chemical Industrial Co., Ltd.) | 2 parts |

The above composition was melted and kneaded in a kneader equipped with two rollers, crushed by a jet mill, and silica (R-972, supplied by Nippon Aerosil Co., Ltd.) was mixed with 100 parts of the above particles to prepare the electrically insulating non-magnetic toner. The volumetric resistivity of the electrically insulating non-magnetic toner was $9\times10^{9}\Omega\cdot$cm.

The electrically conductive magnetic toner and the electrically insulating non-magnetic toner, both prepared as above, were mixed at a ratio of 70/30 by weight to produce the toner for developing the static charge image of the present invention.

(COMPARATIVE EXAMPLE 7)

| | |
|---|---|
| Epoxy resin (Epicoat 1004, supplied by Yuka Shell Epoxy KK) | 43 parts |
| Magnetite (EPT-500, supplied by Toda Kogyo Corp.) | 50 parts |
| Carbon black (Ketjen EC, supplied by Lion Akzo Co., Ltd.) | 7 parts |

The above composition was melted and kneaded in a kneader equipped with two rollers, crushed by a jet mill, and classified to produce electrically conductive magnetic toner particles having a volumetric average size of 9 μm. Its volumetric resistivity was $6\times10^{4}\Omega\cdot$cm.

The above electrically conductive magnetic toner and the electrically insulating non-magnetic toner prepared in EXAMPLE 3 were mixed at a ratio of 70/30 by weight to produce the toner for developing the static charge image of COMPARATIVE EXAMPLE 7.

(COMPARATIVE EXAMPLE 8)

| | |
|---|---|
| Styrene acrylic resin (Mw: 120,000, Mn: 6,000, Mw/Mn: 20) | 80 parts |
| Polypropylene (Viscol 660P: supplied by Sanyo Chemical Industries, Ltd.) | 3 parts |
| Carbon black (#40, supplied by Mitsubishi Kasei corporation) | 15 parts |
| Monoazo metal complex dye (Bontron S-44, supplied by Orient Chemical Industrial Co., Ltd.) | 2 parts |

The above composition was melted and kneaded in a kneader equipped with two rollers, crushed by a jet mill, and classified to produce toner particles having a volumetric average size of 11 μm. 0.2 parts by weight of hydrophobic silica (R-972, supplied by Nippon Aerosil Co., Ltd.) were mixed with 100 parts of the above particles to prepare the electrically insulating non-magnetic toner. The volumetric resistivity of the electrically insulating non-magnetic toner was $7\times10^{8}\Omega\cdot$cm.

The electrically conductive magnetic toner prepared in EXAMPLE 3 and the above electrically insulating non-magnetic toner were mixed at a ratio of 70/30 by weight to produce the toner for developing the static charge image of COMPARATIVE EXAMPLE 8.

(COMPARATIVE EXAMPLE 9)

Only the electrically conductive magnetic toner prepared in EXAMPLE 3 was used to produce the toner for developing the static charge image of COMPARATIVE EXAMPLE 9.

(COMPARATIVE EXAMPLE 10)

The electrically conductive magnetic toner and the electrically insulating non-magnetic toner, both prepared in EXAMPLE 3, were mixed at a ratio of 50/50 by weight to produce the toner for developing the static charge image of COMPARATIVE EXAMPLE 10.

(COMPARATIVE EXAMPLE 11)

The same procedure as used for EXAMPLE 3 was repeated to produce electrically insulating, non-magnetic toner having a volumetric average particle size of 9 μm.

The electrically conductive magnetic toner prepared in EXAMPLE 3 and the above electrically insulating non-magnetic toner were mixed at a ratio of 70/30 by weight to produce the toner for developing the static charge image of COMPARATIVE EXAMPLE 11.

(COMPARATIVE EXAMPLE 12)

The same procedure as used for EXAMPLE 3 was repeated to produce the electrically insulating non-magnetic toner having a volumetric average particle size of 15 μm.

The electrically conductive magnetic toner prepared in EXAMPLE 3 and the above electrically insulating non-magnetic toner were mixed at a ratio of 70/30 by weight, to produce the toner for developing the static charge image of COMPARATIVE EXAMPLE 12.

The toners for developing the static charge image, prepared in EXAMPLES 3 and 4 and COMPARATIVE EXAMPLES 7 through 12, were tested by an LED reversal printer operating at a developing potential of 40 V. The results are given in Table 2.

Image concentration and fog level in Table 2 were determined by a reflection density meter (Macbeth RD914) and a Reflectometer (TC-60, supplied by Tokyo Denshoku Co., Ltd.), respectively.

TABLE 2

| Samples | Image Concentration | Fog Level | Image Quality and Other Remarks |
|---|---|---|---|
| EXAMPLE 3 | 1.38 | 0.005 | Image quality was good |
| EXAMPLE 4 | 1.39 | 0.006 | Image quality was good |
| COMPARATIVE EXAMPLE 7 | 1.08 | 0.009 | Image quality was good |
| COMPARATIVE EXAMPLE 8 | 1.22 | 0.014 | The toner was scattered to some extent |
| COMPARATIVE EXAMPLE 9 | 0.52 | 0.005 | Image quality was good |
| COMPARATIVE EXAMPLE 10 | 1.39 | 0.022 | The toner was scattered |
| COMPARATIVE EXAMPLE 11 | 1.38 | 0.015 | Image quality was good |
| COMPARATIVE EXAMPLE 12 | 1.39 | 0.005 | Letters unreadable |

As illustrated in Table 2, the toners for developing the static charge image of the present invention produced satisfactory image concentration and high-quality images having little fog. By contrast, concentrations of images formed by the toners of COMPARATIVE EXAMPLES 7 and 9 were low, and the images formed by the toners of COMPARATIVE EXAMPLES 8, 10, and 11 were fogged. It was confirmed that the toner of COMPARATIVE EXAMPLE 12 is impractical due to the low-quality images with unreadable letters that it produced.

(EXAMPLE 5)

| | |
|---|---|
| Epoxy resin (Epicoat 1004, supplied by Yuka Shell Epoxy KK) | 40 parts |
| Magnetite (KBC-100, supplied by Kanto Denka Kogyo Co., Ltd.) | 50 parts |
| Carbon black (Ketjen EC, supplied by Lion Akzo Co., Ltd.) | 10 parts |

The above composition was melted and kneaded in a kneader equipped with two rollers, crushed by a jet mill, and classified to produce electrically conductive magnetic toner particles having a volumetric average size of 9 μm. Its volumetric resistivity was $5\times10^{2}\Omega\cdot$cm.

| | |
|---|---|
| Styrene acrylic resin (Mw: 120,000, Mn: 6,000, Mw/Mn: 20) | 90 parts |
| Polypropylene (Viscol 660P: supplied by Sanyo Chemical Industries, Ltd.) | 3 parts |
| Carbon black (#40, supplied by Mitsubishi Kasei corporation) | 5 parts |
| Monoazo metal complex dye (Bontron S-44, supplied by Orient Chemical Industrial Co., Ltd.) | 2 parts |

The above composition was melted and kneaded in a kneader equipped with two rollers, crushed by a jet mill, classified, and impacted in a high-speed air flow using a Nara hybridization system in order to produce toner particles having a volumetric average size of 9 μm. 0.2 parts by weight of hydrophobic silica (R-972, supplied by Nippon Aerosil Co., Ltd.) were mixed with 100 parts of the above particles to prepare the electrically insulating non-magnetic toner. The volumetric resistivity of the electrically insulating non-magnetic toner was $7\times10^{10}\Omega\cdot$cm and its sphericalness was 0.58.

The electrically conductive magnetic toner and the electrically insulating non-magnetic toner, both as prepared above, were mixed at a ratio of 70/30 by weight to produce the toner for developing the static charge image of the present invention.

(EXAMPLE 6)

| | |
|---|---|
| Styrene monomer | 75 parts |
| Butyl acrylate | 10 parts |
| Polypropylene (Viscol 660P, supplied by Sanyo Chemical Industries, Ltd.) | 3 parts |
| Carbon black (#40, supplied by Mitsubishi Kasei corporation) | 5 parts |
| Benzoyl peroxide (as polymerization initiator) | 5 parts |
| Monoazo metal complex dye (Bontron S-44, supplied by Orient Chemical Industrial Co., Ltd.) | 2 parts |

The above composition was well mixed, suspension-polymerized, dehydrated, washed, and dried to produce toner particles having a volumetric average size of 9 μm. 0.2 parts by weight of hydrophobic silica (R-972, supplied by Nippon Aerosil Co., Ltd.) were mixed with 100 parts of the above particles to prepare the electrically insulating non-magnetic toner. The volumetric resistivity of the electrically insulating non-magnetic toner was $3\times10^{10}\Omega\cdot$cm, and its sphericalness was 0.78.

The electrically conductive magnetic toner prepared in EXAMPLE 5 and the electrically insulating non-magnetic toner prepared in EXAMPLE 6 were mixed at a ratio of 70/30 by weight to produce the toner for developing the static charge image of the present invention.

(COMPARATIVE EXAMPLE 13)

| | |
|---|---|
| Epoxy resin (Epicoat 1004. supplied by Yuka Shell Epoxy KK) | 43 parts |
| Magnetite (EPT-500, supplied by Toda Kogyo Corp.) | 50 parts |
| Carbon black (Ketjen EC, supplied by Lion Akzo Co., Ltd.) | 7 parts |

The above composition was melted and kneaded in a kneader equipped with two rollers, crushed by a jet mill, and classified to produce electrically conductive magnetic toner particles having a volumetric average size of 9 μm. Its volumetric resistivity was $6\times10^{4}\Omega\cdot$cm.

The above electrically conductive magnetic toner and the electrically insulating non-magnetic toner prepared in EXAMPLE 5 were mixed at a ratio of 70/30 by weight to produce the toner for developing the static charge image of COMPARATIVE EXAMPLE 13.

(COMPARATIVE EXAMPLE 14)

| | |
|---|---|
| Styrene monomer | 73 parts |
| Butyl acrylate | 8 parts |
| Polpropylene (Viscol 660P: supplied by Sanyo Chemical Industries, Ltd.) | 3 parts |

-continued

| | |
|---|---|
| Carbon black (#40, supplied by Mitsubishi Kasei Corporation) | 9 parts |
| Benzoyl peroxide (as polymerization initiator) | 5 parts |
| Monoazo metal complex dye (Bontron S-44, supplied by Orient Chemical Industrial Co., Ltd.) | 2 parts |

The above composition was well mixed, suspension-polymerized, dehydrated, washed, and dried to produce toner particles having a volumetric average size of 9 μm. 0.2 parts by weight of hydrophobic silica (R-972, supplied by Nippon Aerosil Co., Ltd.) were mixed with 100 parts of the above particles to prepare the eclectically insulating non-magnetic toner. The volumetric resistivity of the electrically insulating non-magnetic toner was $6\times10^{8}\Omega\cdot$cm, and its sphericalness was 0.75.

The electrically conductive magnetic toner prepared in EXAMPLE 5 and the above electrically insulating non-magnetic toner were mixed at a ratio of 70/30 by weight to produce the toner for developing the static charge image of COMPARATIVE EXAMPLE 14.

(COMPARATIVE EXAMPLE 15)

The same procedure as used for EXAMPLE 5 was repeated (except that no impact was imparted to the particle in an air flow) to prepare the electrically insulating non-magnetic toner. The volumetric resistivity of the electrically insulating non-magnetic toner was $7.2\times10^{10}\Omega\cdot$cm, and its sphericalness was 0.42.

The electrically conductive magnetic toner prepared in EXAMPLE 5 and the above electrically insulating non-magnetic toner were mixed at a ratio of 70/30 by weight to produce the toner for developing the static charge image of COMPARATIVE EXAMPLE 15.

(COMPARATIVE EXAMPLE 16)

Only the electrically conductive magnetic toner prepared in EXAMPLE 5 was used to produce the toner for developing the static charge image of COMPARATIVE EXAMPLE 16.

(COMPARATIVE EXAMPLE 17)

The electrically conductive magnetic toner and the electrically insulating non-magnetic toner, both prepared in EXAMPLE 5, were mixed at a ratio of 50/50 by weight to produce the toner for developing the static charge image of COMPARATIVE EXAMPLE 17.

The toners for developing the static charge image, prepared in EXAMPLES 5 and 6 and COMPARATIVE EXAMPLES 13 through 17, were tested by an LED reversal printer operating at a developing potential of 40 V. The results are given in Table 3.

TABLE 3

| Samples | Image Concentration | Fog Level | Image Quality and Other Remarks |
|---|---|---|---|
| EXAMPLE 5 | 1.39 | 0.005 | Image quality was good |
| EXAMPLE 6 | 1.40 | 0.006 | Image quality was good |
| COMPARATIVE EXAMPLE 13 | 1.05 | 0.007 | Image quality was good |
| COMPARATIVE EXAMPLE 14 | 1.20 | 0.012 | The tone was scattered to some extent |
| COMPARATIVE EXAMPLE 15 | 1.39 | 0.020 | Some letters were scattered |

TABLE 3-continued

| Samples | Image Concentration | Fog Level | Image Quality and Other Remarks |
|---|---|---|---|
| COMPARATIVE EXAMPLE 16 | 0.52 | 0.005 | Image quality was good |
| COMPARATIVE EXAMPLE 17 | 1.40 | 0.017 | The toner was scattered |

Image concentration and fog level in Table 3 were determined by a reflection density meter (Macbeth RD914) and a Reflectometer (TC-6D, supplied by Tokyo Denshoku Co., Ltd.), respectively.

As illustrated in Table 3, the toners for developing the static charge image of the present invention produced satisfactory image concentration and high-quality images having little fog. By contrast, it was confirmed that the density of image formed by the toner of COMPARATIVE EXAMPLE 13, 14, and 16 were low, and the images formed by the toners of COMPARATIVE EXAMPLES 14, 15, and 17 were fogged to such an extent as to be impractical.

The present invention provides toner for developing a static charge image that allows a low-potential developing apparatus to produce high-quality images with sufficient image concentration and little fog.

What is claimed is:

1. A toner for developing a static image comprising an electrically conductive magnetic toner and an electrically insulating non-magnetic toner, wherein said electrically conductive magnetic toner contains magnetic powder, and a volumetric resistivity not greater than $1\times10^{3}\Omega\cdot$cm; and said electrically insulating non-magnetic has a coloring agent attached to the surface thereof, and a volumetric resistivity not less than $1\times10^{9}\Omega\cdot$cm.

2. A toner for developing a static image characterized by comprising electrically conductive magnetic toner and electrically insulating non-magnetic toner, wherein said electrically conductive magnetic toner contains 30% to 70% by weight of magnetic powder and has a volumetric resistivity not greater than $1\times10^{3}\Omega\cdot$cm; and said electrically insulating non-magnetic toner having a volumetric resistivity not less than $1\times10^{9}\Omega\cdot$cm, wherein 0.2 to 2.0 parts by weight of a coloring agent are attached at the surface thereof to 100 parts by weight of the particles of said electrically insulating non-magnetic toner.

3. A toner for developing a static image comprising an electrically conductive magnetic toner and an electrically insulating non-magnetic toner, wherein said electrically conductive magnetic toner contains 30% to 70% by weight of magnetic powder and has a volumetric resistivity not greater $1\times10^{3}\Omega\cdot$cm; and said electrically insulating non-magnetic toner has a volumetric resistivity not less than $1\times10^{9}\Omega\cdot$cm, wherein 0.2 to 2.0 parts by weight of carbon black are attached at the surface thereof beforehand to 100 parts by weight of the particles of said electrically insulating non-magnetic toner; and wherein said electrically conductive magnetic toner and said electrically insulating non-magnetic toner are blended in a ratio ranging between 60:40 and 90:10 by weight.

4. A toner for developing a static image comprising an electrically conductive magnetic toner and an electrically insulating non-magnetic toner, wherein said electrically conductive magnetic toner contains 30% to 70% by weight of magnetic powder and having a volumetric resistivity not greater than $1\times10^3\Omega\cdot$cm; and said electrically insulating non-magnetic toner has a volumetric resistivity not less than $1\times10^9\Omega\cdot$cm; wherein said electrically conductive magnetic toner and said electrically insulating non-magnetic toner are blended in a ratio ranging between 60:40 and 90:10 by weight, and said electrically insulating non-magnetic toner has a volumetric average particle size 1.1 to 1.5 times larger than that of said electrically conductive magnetic toner.

5. A toner for developing a static image comprising an electrically conductive magnetic toner and an electrically insulating non-magnetic toner, wherein said electrically conductive magnetic toner contains 30% to 70% by weight of magnetic powder and has a volumetric resistivity not greater than $1\times10^3\Omega\cdot$cm; and said electrically insulating non-magnetic toner has a volumetric resistivity not less than $1\times10^9\Omega\cdot$cm and a sphericalness not less than 0.5; wherein said electrically conductive magnetic toner and said electrically insulating non-magnetic toner are mixed together at a ratio ranging from 60:40 to 90:10 by weight.

6. A toner for developing a static image according to claim 3, wherein said electrically insulating non-magnetic toner further comprises at least one of styrene acrylic resin, polypropylene, carbon black, and monoazo metal complex dye.

* * * * *